US006171547B1

(12) United States Patent
Sagara et al.

(10) Patent No.: US 6,171,547 B1
(45) Date of Patent: Jan. 9, 2001

(54) AUSTENITIC STAINLESS STEEL HAVING EXCELLENT SULFURIC ACID CORROSION RESISTANCE AND EXCELLENT WORKABILITY

(75) Inventors: Masayuki Sagara; Shigeki Azuma; Haruhiko Kajimura, all of Hyogo (JP)

(73) Assignee: Sumitomo Metal Industries, Ltd., Osaka (JP)

( * ) Notice: Under 35 U.S.C. 154(b), the term of this patent shall be extended for 0 days.

(21) Appl. No.: 09/287,106

(22) Filed: Apr. 7, 1999

Related U.S. Application Data

(63) Continuation of application No. PCT/JP98/03567, filed on Aug. 10, 1998.

(30) Foreign Application Priority Data

Aug. 13, 1997 (JP) ..... 9-218432

(51) Int. Cl.[7] ..... C22C 38/42; C22C 38/44
(52) U.S. Cl. ..... 420/49; 420/53; 148/327
(58) Field of Search ..... 148/327; 420/49, 420/53

(56) References Cited

U.S. PATENT DOCUMENTS 4,556,423 * 12/1985 Kondo et al. .
4,816,217 * 3/1989 Bassford et al. ..... 420/49

FOREIGN PATENT DOCUMENTS

2314661 * 10/1973 (DE) .
3300392 * 7/1983 (DE) .
0155011 A2 9/1985 (EP) .
0690141 A1 1/1996 (EP) .
2206893 1/1989 (GB) .
52-124411 10/1977 (JP) .
56-93860 7/1981 (JP) .
58-52463 3/1983 (JP) .
64-21038 1/1989 (JP) .
2-170946 7/1990 (JP) .
2-290949 11/1990 (JP) .
5-156410 6/1993 (JP) .
4-346638 12/1993 (JP) .
6-128699 5/1994 (JP) .
9-176800 7/1997 (JP) .

OTHER PUBLICATIONS

"*Sulfur Dewpoint Corrosion*" (vol. 26 (1977) p. 731 to 740).
Patent Abstracts of Japan, vol. 007, No. 139, (C–171), Jun. 17, 1983 (Jun. 17, 1983) & JP 58052463A (Kubota Tekko KK), Mar. 28, 1983 (Mar. 28, 1983) abstract.

* cited by examiner

*Primary Examiner*—Deborah Yee
(74) *Attorney, Agent, or Firm*—Clark & Brody

(57) ABSTRACT

An austenitic stainless steel of the present invention has the following chemical composition based on percent by weight: C: 0.05% or less, Si: 1.0% or less, Mn: 2.0% or less, P: 0.04% or less, S: 0.01% or less, Ni: from 12 to 27%, Cr: from 15 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01% or less in total, and the balance Fe and unavoidable impurities. The austenitic stainless steel has excellent sulfuric acid corrosion resistance and excellent workability.

15 Claims, 2 Drawing Sheets f n 2

AUSTENITIC STAINLESS STEEL HAVING EXCELLENT SULFURIC ACID CORROSION RESISTANCE AND EXCELLENT WORKABILITY

This is a continuation of International Application PCT/JP98/03567 filed on Aug. 10, 1998.

TECHNICAL FIELD

The entire disclosure of the International application No. PCT/JP98/03567, filed on Aug. 10, 1998 including specification, claims and summary, are incorporated herein by reference in its entirety.

The present invention relates to an austenitic stainless steel which has excellent sulfuric acid corrosion resistance and excellent workability. In particular, the present invention relates to an austenitic stainless steel which has excellent resistance against sulfuric acid dew-point corrosion, a problem characteristic to a variety of materials for heat exchangers, flues and chimneys used for thermal power plants and industrial use boilers, as well as structural materials including those for flue gas desulfurization equipment used in various industries and for facilities used in a sulfuric acid environment. And also, the present invention relates to an austenitic stainless steel which has excellent workability, especially excellent hot workability.

TECHNICAL BACKGROUND

So-called "fossil fuels" such as petroleum and coal, which are used as fuel for thermal power plants and industrial boilers, contain sulfur (S). Therefore, combustion of fossil fuels produces sulfur oxides ($SO_x$) in the exhaust gas. When the temperature of the exhaust gas drops, $SO_x$ reacts with water in the gas to produce sulfuric acid, which is condensed on a material surface having a temperature lower than a dew-point, permitting occurrence of sulfuric acid dew-point corrosion. Similarly, in flue gas desulfurization equipment used in various industries, reduction of gas temperature causes sulfuric acid dew-point corrosion, if an $SO_x$-containing gas flows in the equipment. Hereinafter in this specification, for the sake of simplicity, the $SO_x$-containing gas is referred to as exhaust gas.

Because of the above-mentioned phenomenon, in heat exchangers and other equipment used for exhaust gas systems, the exhaust gas temperature has been maintained at 150° C. or higher so that sulfuric acid does not form dew condensation on the material surface.

However, in view of the recent increase of energy demand, and also from the viewpoint of the effective use of energy, recycling of heat energy is desired to be as effective as possible. For example, attempts have been made to lower the exhaust gas temperature of a heat exchanger to a point lower than the dew-point of sulfuric acid. Thus, materials having resistance against sulfuric acid have been demanded.

Unless the exhaust gas temperature is maintained at 150° C. or higher, an exhaust gas of a typical composition and having a temperature of about 140° C. permits dew condensation of about 80% concentrated sulfuric acid on the material surface. For such environment, various so-called "low alloy steels" have been used as steel stocks for structural use. This is because low alloy steels have higher levels of resistance against a high-temperature and high-concentration sulfuric acid than do general-purpose stainless steels.

*Boshoku Gijutsu* (vol. 26 (1977), p. 731 to 740) describes that sulfuric acid corrosion accelerates in a temperature range of 20 to 60° C. lower than a sulfuric acid dew-point. This is because that the amount of condensed sulfuric acid reaches a maximum in the above-described temperature range. For this reason, unless the exhaust gas is maintained at 150° C. or higher, generally, resistance against corrosion is most required in a temperature range in the vicinity of 100° C, where the concentration of sulfuric acid becomes about 70%. However, in this temperature range, to say nothing of general-purpose stainless steels, even low alloy steels cannot be used because of high corrosion.

Patent Application Laid-Open (Kokai) Nos. 56-93860, 2-170946, 4-346638 and 5-156410 disclose that specific corrosion resistance materials are usable for a sulfuric acid environment.

Patent Application Laid-Open (Kokai) No. 6-128699 discloses a highly alloyed austenitic stainless steel which has excellent corrosion resistance in an environment containing sulfate ion, halide ion and oxidizing metal ion simultaneously. Patent Application Laid-Open (Kokai) No. 64-21038 discloses an austenitic stainless steel which has excellent pitting corrosion resistance, crevice corrosion resistance, stress corrosion cracking resistance and acid resistance. And Patent Application Laid-Open (Kokai) No. 58-52463 discloses a stainless steel which exhibits corrosion resistance in an environment containing hydrogen sulfide, and moreover, has excellent mechanical properties.

DISCLOSURE OF THE INVENTION

Of the materials proposed as having sulfuric acid corrosion resistance, Patent Application Laid-Open (Kokai) No. 56-93860 discloses "an anti-sulfuric acid corrosion alloy", which exhibits excellent corrosion resistance in a sulfuric acid environment of about 100° C. in temperature and 95% or higher in concentration. However, because the alloy disclosed in this publication has a Cu content of as low as 0.5 to 3.0%, the alloy has poor corrosion resistance in, for example, the aforementioned sulfuric acid environment of about 100° C., where sulfuric acid concentration is about 70%. The above-mentioned alloy contains Si in an amount of 1.5% or higher, imparting to the alloy high corrosion resistance in the above-described sulfuric acid environment (temperature: about 100° C., sulfuric acid concentration: 95% or higher) . For this reason, in order to improve corrosion resistance in the environment to which the present invention is directed (for example, temperature: about 100° C., sulfuric acid concentration: about 70%), mere incorporation of a great amount of Cu into the above-described alloy, as a base alloy, results in extremely poor hot workability.

Patent Application Laid-Open (Kokai) No. 2-170946 discloses "a highly alloyed stainless steel for flues, chimneys and desulfurization equipment having excellent corrosion resistance", which exhibits corrosion resistance in an environment where 1000 ppm $Fe^{3+}$ and 1000 ppm $Cl^-$ are added to 50% sulfuric acid in concentration. However, because the stainless steel disclosed in this publication has a low Cu content, i.e., from 0.5 to 2.0 wt. % Cu, the steel has poor sulfuric acid corrosion resistance in, for example, the above-stated environment where the temperature is about 100° C. and the sulfuric acid concentration is about 70%.

Patent Application Laid-Open (Kokai) No. 4-346638 discloses "a sulfuric acid dew-point corrosion-resistant stainless steel having excellent hot workability", which contains 0.05 wt. % or more N (nitrogen) in order to stabilize austenitic structure and obtain corrosion resistance. However, the present inventors' investigation reveals that incorporation of 0.05 wt. % or more N reduces sulfuric acid corrosion resistance of austenitic stainless steels to which Cu, Cr and Mo have been added in combination. Moreover, the investigation reveals that in the case of N content of 0.05 wt. % or higher, increase of Cu content to improve sulfuric acid corrosion resistance results in an extreme reduction of hot workability in a temperature range of lower than 1000° C.

"A stainless steel for high-temperature and high-concentration sulfuric acid", which is disclosed in Patent Application Laid-Open (Kokai) No. 5-156410, has no Cu in its chemical composition. So, the stainless steel has poor corrosion resistance in, for example, the above-mentioned environment where the temperature is about 100° C. and the sulfuric acid concentration is about 70%.

Patent Application Laid-Open (Kokai) No. 6-128699 entitled "a highly alloyed austenitic stainless steel having excellent hot workability and excellent localized corrosion resistance" discloses techniques for obtaining corrosion resistance, especially localized corrosion resistance for flue gas scrubbing equipment of an incineration system for urban garbage and so on. Therefore, the steel has excellent localized corrosion resistance in an environment where sulfate ion, halide ion and oxidizing metal ion exist simultaneously. However, in the above-described environment where the temperature is about 100° C. and the sulfuric acid concentration is about 70%, the steel does not always provide adequate corrosion resistance. This is because whereas "localized corrosion" is pitting corrosion, crevice corrosion and stress corrosion cracking caused by chloride ion ($Cl^-$), "sulfuric acid dew-point corrosion" is a phenomenon of active dissolution, i.e., thickness reduction of steel caused by homogeneous dissolution. This means the mechanism of "sulfuric acid dew-point corrosion" and that of "localized corrosion" differ. In addition, in the case of the steel described in this publication, since the lower limit of Cr content is 20 wt. % and the upper limit of Cu content is 4 wt. %, it does not always exhibit excellent hot workability and excellent corrosion resistance simultaneously in the above-described environment of sulfuric acid.

Patent Application Laid-Open (Kokai) No. 64-21038 discloses "a highly corrosion-resistant austenitic stainless steel having excellent hot workability", which requires the N content to be 0.4% or less. However, in effect the steel disclosed therein contains 0.1% or more N, because N is an austenite-forming element and, moreover, is effective for obtaining pitting corrosion resistance and strength, as is apparent from the description of invented steels in Table 1 in the Example section and the description of element limitation provided for N. However, as mentioned above, incorporation of 0.05% or more N in turn results in poor sulfuric acid corrosion resistance to austenitic stainless steels to which Cu, Cr and Mo have been added in combination. Further, in the case of incorporation of 0.05% or more N, increase of Cu content to improve sulfuric acid corrosion resistance results in extreme reduction of hot workability in a temperature range of lower than 1000° C.

Patent Application Laid-Open (Kokai) No. 58-52463 discloses "a stainless steel having excellent corrosion resistance and excellent mechanical properties", which is a duplex stainless steel having excellent corrosion resistance in an environment where hydrogen sulfide and chloride ion exist and consisting of the ferritic phase and the austenitic phase. In the above-described environment where hydrogen sulfide and chloride ion exist simultaneously, the problem is pitting corrosion, which is "localized corrosion" and not "sulfuric acid dew-point corrosion"; as mentioned above, they are two different corrosion mechanisms. Thus, the stainless steel disclosed in this publication has poor corrosion resistance in an environment of sulfuric acid dew-point. corrosion and exhibits no resistance at all in, for example, the above-mentioned environment where the temperature is about 100° C. and the sulfuric acid concentration is about 70%.

Patent Application Laid-Open (Kokai) No. 9-176800 discloses "an austenitic stainless steel having excellent anti-microbial activity", which has a high Cu content. The austenitic stainless steel disclosed therein, is merely directed to "anti-microbial activity". This steel has a high Cu content, but the Cu precipitates as a secondary phase containing Cu as the main component by aging from the hot rolling to the final products. Therefore, the amount of Cu present in a matrix of the steel in the form of solid solution becomes low, and the resultant steel has poor corrosion resistance in the above-mentioned environment of about 100° C. having the sulfuric acid concentration of about 70%. Furthermore, if the Mo content of the steel is low, the steel has considerably deteriorated corrosion resistance in the above-described environment where the temperature is about 100° C. and the sulfuric acid concentration is about 70%. Moreover, because of rather low Ni content, the steel may have poor corrosion resistance in the aforementioned environment of about 100° C. having the sulfuric acid concentration of about 70%.

In view of the foregoing, an object of the present invention is to provide an austenitic stainless steel which has excellent corrosion resistance in an environment where high-concentration sulfuric acid is condensed (environment of sulfuric acid dew-point), and which has excellent hot workability, and which can be used as materials for exhaust gas systems, such as thermal power plant boilers or industrial use boiler equipment (for example, heat exchangers, flues and chimneys), and various types of materials used for flue gas desulfurization equipment in various industries, and structural materials for use in a sulfuric acid environment.

Hereinafter in this specification, the expression "environment where high-concentration sulfuric acid is condensed" refers to an environment where the temperature is "from 50 to 100° C" and the sulfuric acid of "40 to 70%" in concentration is condensed. As mentioned above, sulfuric acid corrosion reaches its peak within a range where the temperature is 20 to 60° C. lower than a sulfuric acid dew-point. Therefore, with respect to corrosion resistance, the present invention attempts to enhance corrosion resistance in an environment where corrosion reaches a maximum; that is, in the above-stated environment where the temperature is about 100° C. and the sulfuric acid concentration is about 70%.

In order to smoothly produce different types of materials, such as steel pipes, steel plates and forged products, from stainless steels through a hot working process, a concrete goal, in terms of hot workability in the present invention, is to realize a reduction in area of 50% or more in a high-temperature tensile test, using a Gleeble thermomechanical simulator in Examples described later.

The gist of the present invention will be summarized below.

"An austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 27%, Cr: from 15 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca:

0.01% or less, B: 0.01% or less, rare earth elements: 0.01% or less in total, and the balance Fe and unavoidable impurities."

BEST MODE FOR CARRYING OUT THE INVENTION

Figure 1:
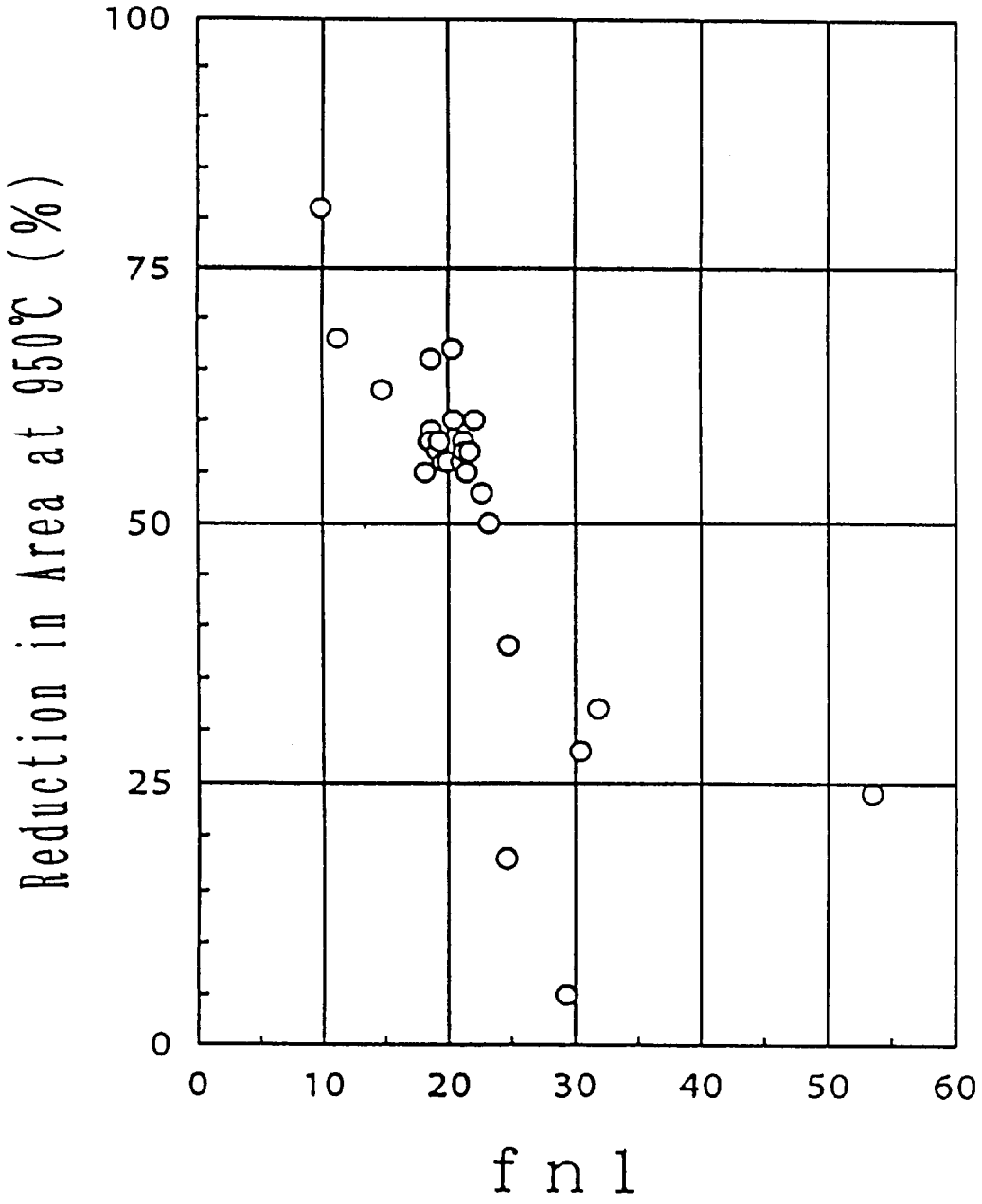
FIG. 1 is a graph showing the relationship between hot workability at 950° C. of the steels used in Examples and fn1, which is expressed by the equation (1) mentioned later.

In order to give Ni—Cr austenitic stainless steels excellent corrosion resistance in the "environment where high-concentration sulfuric acid is condensed", the present inventors performed corrosion tests for investigating the effects of alloying elements on corrosion caused by sulfuric acid at a wide concentration of ranges. As a result, the inventors have found the following information.

(a) As sulfuric acid concentration increases, corrosion of austenitic stainless steels tends to progress considerably. In an actual environment that causes sulfuric acid dew-point corrosion, the corrosion is also related to the amount of condensed sulfuric acid. As the temperature increases, the amount of sulfuric acid to be condensed decreases. Therefore, maximum corrosion occurs in the environment where the sulfuric acid concentration is 70% and the temperature is 100° C. Imparting excellent corrosion resistance to austenitic stainless steels in this environment requires both electrochemical suppression of anodic active dissolution and incorporation of Cu capable of suppressing hydrogen generation, a cathodic reaction, in an amount of more than 3.0% by weight.

(b) In an environment where the temperature is 140° C. and sulfuric acid concentration is as high as 80%, incorporation of more than 2.0% Mo tends to result in poor corrosion resistance. However, combined incorporation of Cu in an amount described in (a) above and Mo in an amount of more than 2% by weight, along with simultaneous incorporation of Cr in a proper amount, and suppression in N content can impart excellent corrosion resistance to austenitic stainless steels, even in the case where Mo content is more than 2.0% by weight in the above-mentioned "environment where high-concentration sulfuric acid is condensed".

(c) Incorporation of Cu and Mo in amounts described in (a) and (b) above, the suppression of N content to a low level, and an adjustment in relation of Cu, Mo and N contents, can impart excellent hot workability and excellent corrosion resistance to austenitic stainless steels in the "environment where high-concentration sulfuric acid is condensed".

The present invention has been accomplished based on the above-described findings.

Next, the present invention will be described in detail. The symbol "%" of the content of each chemical component means "percent by weight".

C: 0.05% or less

C has an effect of improving strength. However, C binds with Cr so as to form Cr carbide in the grain boundaries, resulting in lowered intergranular corrosion resistance. Therefore, the C content shall be 0.05% or less. If improved strength is needed, C may be over 0.03 to 0.05%. If corrosion resistance has priority, the C content is advantageously set lower. In this case, the C content shall be, desirably, 0.03% or less.

Si: 1.0% or less

Si may be omitted. Si, if added, provides a deoxidation effect. In order to reliably obtain this effect, the Si content shall be, desirably, not less than 0.05%. However, when the Si content is in excess of 1.0%, with the increase of the Cu content, deterioration of hot workability is accelerated, which leads to great difficulty in industrial manufacture of products. Therefore, the Si content shall be 1.0% or less. In the case where the Al content is considerably lowered in order to improve hot workability, the Si content shall be, desirably, 0.1% or more so as to obtain sufficient deoxidation effect.

Mn: 2.0% or less

Mn may be omitted. Mn, if added, fixes S so as to improve hot workability, and stabilizes the austenitic phase. To reliably obtain this effect, the Mn content shall be, desirably, not less than 0.1%. However, when the Mn content is in excess of 2.0%, the effect is saturated, resulting in unnecessary cost. Therefore, the Mn content shall be 2.0% or less.

P: 0.04% or less

Since P degrades hot workability and corrosion resistance, the P content is preferably low. Especially, when the P content exceeds 0.04%, corrosion resistance significantly degrades in the "environment where high-concentration sulfuric acid is condensed". Therefore, the P content shall be 0.04% or less.

S: 0.01% or less

Since S is an element which degrades hot workability, the S content is preferably low. Especially, when the S content exceeds 0.01%, hot workability significantly degrades. Therefore, the S content shall be 0.01% or less.

Ni: from 12 to 27%

Ni is effective in stabilizing the austenitic phase and enhancing corrosion resistance in the aforementioned "environment where high-concentration sulfuric acid is condensed". In order to sufficiently secure these effects, the Ni content must be 12% or more. However, when the Ni content is in excess of 27%, the effects are saturated. In this case, since Ni is an expensive element, the cost becomes considerably high, resulting in a disadvantage in terms of economy. Therefore, the Ni content shall be from 12 to 27%. In order to secure sufficient corrosion resistance in the "environment where high-concentration sulfuric acid is condensed", the Ni content shall be, desirably, over 15%, and more desirably, over 20%.

Cr: from 15 to 26%

Cr is an effective element for imparting corrosion resistance to austenitic stainless steels. Especially, in austenitic stainless steels containing N in the limited amount as described later, if Cr is contained therein in an amount of 15% or more, desirably 16% or more, together with Cu and Mo in the below-mentioned amounts, there can be secured excellent corrosion resistance in the "environment where high-concentration sulfuric acid is condensed". However, if the Cr content is excessively high, corrosion resistance is adversely degraded in the aforementioned environment, and hot workability is lowered, even in the case of austenitic stainless steels containing N in a lowered amount together with Cu and Mo. Especially, when the Cr content exceeds 26%, the corrosion resistance of austenitic stainless steels is considerably degraded in the aforementioned environment. Therefore, the Cr content shall be from 15 to 26%. In order to improve hot workability of austenitic stainless steels so as to facilitate the processing of products on an industrial scale, the Cr content shall be, desirably, less than 20%.

Cu: over 3.0 to 8.0%

Cu is an essential element for securing corrosion resistance in the sulfuric acid environment. Through incorporation of Cu in an amount exceeding 3.0% together with Cr in the above-described amount and Mo in the below-described amount, excellent corrosion resistance is imparted to austenitic stainless steels containing N in the below-described amount, in the "environment where high-concentration sulfuric acid is condensed". As the Cu content together with Cr and Mo increases, corrosion resistance improves. Therefore, the Cu content shall be, desirably, over 4.0%, more desirably, over 5.0%. The increased Cu content improves corrosion resistance in the aforementioned environment, but lowers hot workability. Especially, when the Cu content is in excess of 8.0%, hot workability is considerably degraded, even if the N content is set as described later. Therefore, the Cu content shall be over 3.0 to 8.0%.

Mo: over 2.0 to 5.0%

Mo is an effective element for imparting corrosion resistance to austenitic stainless steels. Especially, through incorporation of Mo in an amount exceeding 2.0% together with Cr and Cu in the above-mentioned amounts, excellent corrosion resistance is imparted to austenitic stainless steels having a specified N content (which will be described later) in the above-mentioned "environment where high-concentration sulfuric acid is condensed". However, if the Mo content is excessively high, hot workability is lowered. Especially, when the Mo content is in excess of 5.0%, hot workability degrades considerably, even in the case where the N content is set as described later. Therefore, the Mo content shall be over 2.0 to 5.0%. In order to secure sufficient corrosion resistance in the "environment where high-concentration sulfuric acid is condensed", the Mo content shall be, desirably, more than 3%.

Nb: 1.0% or less

Nb may be omitted. Nb, if added, fixes C so as to improve corrosion resistance, especially intergranular corrosion resistance. In order to reliably obtain the effect, the Nb content shall be, desirably, not less than 0.02%. However, when the Nb content is in excess of 1.0%, nitride is produced even in the case where the N content is set as described later. As a result, corrosion resistance is adversely lowered, and hot workability is degraded. Therefore, the Nb content shall be 1.0% or less.

Ti: 0.5% or less

Ti may be omitted. Ti, if added, as in the case of Nb, fixes C so as to improve corrosion resistance, especially intergranular corrosion resistance. In order to reliably obtain this effect, the Ti content shall be, desirably, not less than 0.01%. However, when the Ti content is in excess of 0.5%, nitride is produced even in the case where the N content is set as described later. As a result, corrosion resistance is adversely lowered, and hot workability is degraded. Therefore, the Ti content shall be 0.5% or less.

W: 5.0% or less

W may be omitted. W, if added, improves corrosion resistance in the "environment where high-concentration sulfuric acid is condensed". In order to reliably obtain this effect, the W content shall be, desirably, not less than 0.1%. However, when the W content is in excess of 5.0%, the effect is saturated, resulting in unnecessary cost. Therefore, the W content shall be 5.0% or less.

Zr: 1.0% or less

Zr may be omitted. Zr, if added, improves corrosion resistance in the "environment where high-concentration sulfuric acid is condensed". In order to reliably obtain the effect, the Zr content shall be, desirably, not less than 0.02%. However, when the Zr content is in excess of 1.0%, the effect is saturated, resulting in unnecessary cost. Therefore, the Zr content shall be 1.0% or less.

Al: 0.5% or less

When the Al content is in excess of 0.5%, hot workability is lowered even in the case of austenitic stainless steels containing N in the below-described amount. Therefore, the Al content shall be 0.5% or less. The lower limit of the Al content may fall within the range of the unavoidable impurity content. However, since Al provides a deoxidation effect, if the aforementioned Si content is set to a considerably low level, Al is preferably added in the amount of 0.02% or more so as to obtain sufficient deoxidation effect. In the case where the Si content is not less than 0.05%, in order to sufficiently obtain the deoxidation effect, the Al content shall be, desirably, not less than 0.01%.

N: under 0.05%

N is an important element in the austenitic stainless steel of the present invention. Conventionally, N has been positively incorporated to steels for the purpose of stabilization of the austenitic structure as well as improvement of resistance to "localized corrosion" , such as pitting corrosion and crevice corrosion. However, in the "environment where high-concentration sulfuric acid is condensed" where the present invention is utilized, N content of 0.05% or more adversely lowers corrosion resistance of austenitic stainless steels, containing Cu in an amount exceeding 3.0%, Mo in an amount exceeding 2.0% and Cr in an amount of 15 to 26%. Also, even in the case where the upper limits of the Cu and Mo contents are set to 8.0% and 5.0% respectively, when the N content is not less than 0.05%, hot workability is lowered. Therefore, in order to impart corrosion resistance and hot workability to austenitic stainless steels in the "environment where high-concentration sulfuric acid is condensed" , the N content shall be under 0.05%. The lower the N content, the better the result.

Ca: 0.01% or less

Ca may be omitted. Ca, if added, binds with S so as to suppress degradation of hot workability. In order to reliably obtain this effect, the Ca content shall be, desirably, not less than 0.0005%. More desirably, the lower limit of the Ca content shall be 0.001%. However, when the Ca content is in excess of 0.01%, the index of cleanliness of the steel is lowered, which leads to formation of scars during hot working. Therefore, the Ca content shall be 0.01% or less.

B: 0.01% or less

B may be omitted. B, if added, has an effect of improving hot workability. In order to reliably obtain this effect, the B content shall be, desirably, not less than 0.0005%. More desirably, the lower limit of the B content shall be 0.001%. However, an excessively high B content facilitates precipitation of Cr—B compounds in the grain boundaries, which leads to degradation of corrosion resistance. Especially, when the B content is in excess of 0.01%, corrosion resistance is considerably degraded. Therefore, the B content shall be 0.01% or less.

Rare earth elements: 0.01% or less in total

Rare earth elements may be omitted. Rare earth elements, if added, improve hot workability. In order to reliably obtain the effect, the total content of all rare earth elements shall be, desirably, not less than 0.0005%. However, when the total content of rare earth elements is in excess of 0.01%, the index of cleanliness of the steel is lowered, which leads to formation of scars during hot working. Therefore, the content of rare earth elements shall be 0.01% or less in total.

As is described in detail in the following Example section, in the case where each of the Cu, Mo and N contents falls within the range as described above, if fn1 expressed by the following equation (1) is 23.0% or less, and fn2 expressed by the following equation (2) is 2.0% or less (in equations (1) and (2), each element symbol shows the amount of the element based on percent by weight), austenitic stainless steels are endowed with better corrosion resistance in the "environment where high-concentration sulfuric acid is condensed" as well as hot workability.

$$fn1=2Cu+0.5Mo+300N \quad (1),$$

$$fn2=\{10/(Cu+0.2)^{2.3}\}+\{5/(Mo+0.1)^2\}+300N^2 \quad (2).$$

In order to enhance hot workability remarkably, fn1 expressed by the above-mentioned equation (1) shall be, 22.6% or less. No particular limitation is imposed on the lower limit of fn1. In the case where each of the Cu, Mo and N contents is at a respective predetermined lower limit, if the lower limit of fn1 is a value close to 7%, hot workability becomes considerably excellent (see FIG. 1).

Also, no particular limitation is imposed on the lower limit of fn2 expressed by the above-mentioned equation (2). The lower limit of fn2 may be a value close to 0.27, in the case where each of the Cu and Mo contents is at a respective predetermined upper limit and the N content is at a predetermined lower limit (see FIG. 2).

EXAMPLES

The present invention is described concretely using examples, which should not be constructed as limiting the present invention thereto.

Example 1

Austenitic stainless steels having chemical compositions shown in Tables 1 and 2 were manufactured through a melting process in a 20 kg vacuum induction melting furnace. Steels 1 to 16 in Table 1 are examples of the present invention, and contain each component element in an amount falling in a range specified by the present invention. Steels 17 to 28 in Table 2 are comparative examples, in which any of component elements falls outside a range specified by the present invention. Tables 1 and 2 include fn1 expressed by the above-mentioned equation (1) and fn2 expressed by the above-mentioned equation (2).

TABLE 1

| | Chemical composition (percent by weight) Balance: Fe and unavoidable impurities | | | | | | | | | | | | | | | |
|---|---|---|---|---|---|---|---|---|---|---|---|---|---|---|---|---|
| Steel | C | Si | Mn | P | S | Ni | Cr | Mo | Cu | N | Al | Ca | B | REM | fn1 | fn2 |
| 1 | 0.029 | 0.54 | 1.21 | 0.026 | 0.002 | 14.22 | 18.68 | 2.1 | 6.3 | 0.021 | 0.312 | 0.0014 | — | — | 20.0 | 1.30 |
| 2 | 0.021 | 0.68 | 1.24 | 0.024 | 0.001 | 14.13 | 17.23 | 2.5 | 5.1 | 0.024 | 0.071 | — | — | — | 18.7 | 1.13 |
| 3 | 0.026 | 0.55 | 1.23 | 0.028 | 0.002 | 16.38 | 18.36 | 2.4 | 5.3 | 0.026 | 0.061 | — | — | — | 19.6 | 1.20 |
| 4 | 0.014 | 0.58 | 1.18 | 0.026 | 0.001 | 20.56 | 18.04 | 2.8 | 5.2 | 0.038 | 0.053 | — | — | — | 23.2 | 1.21 |
| 5 | 0.026 | 0.68 | 1.47 | 0.018 | 0.001 | 25.31 | 18.62 | 2.6 | 4.5 | 0.041 | 0.052 | — | — | — | 22.6 | 1.45 |
| 6 | 0.024 | 0.64 | 1.11 | 0.026 | 0.002 | 26.31 | 22.64 | 2.6 | 3.2 | 0.048 | 0.021 | — | — | — | 22.1 | 2.03 |
| 7 | 0.023 | 0.69 | 1.05 | 0.024 | 0.002 | 22.42 | 16.30 | 2.4 | 3.3 | 0.036 | 0.024 | 0.0012 | 0.0008 | 0.0024 | 18.6 | 1.75 |
| 8 | 0.023 | 0.67 | 1.09 | 0.011 | 0.001 | 12.13 | 17.34 | 2.7 | 4.2 | 0.038 | 0.036 | — | — | — | 21.2 | 1.40 |
| 9 | 0.024 | 0.64 | 1.34 | 0.016 | 0.001 | 15.22 | 17.68 | 3.5 | 5.9 | 0.019 | 0.124 | — | — | — | 19.3 | 0.65 |
| 10 | 0.021 | 0.66 | 1.44 | 0.023 | 0.002 | 15.08 | 18.21 | 4.2 | 6.2 | 0.012 | 0.064 | — | — | — | 18.1 | 0.45 |
| 11 | 0.028 | 0.63 | 1.47 | 0.022 | 0.006 | 15.31 | 18.06 | 2.3 | 4.1 | 0.041 | 0.034 | — | 0.0017 | — | 21.7 | 1.72 |
| 12 | 0.021 | 0.69 | 1.40 | 0.026 | 0.007 | 15.09 | 18.09 | 2.4 | 5.1 | 0.024 | 0.065 | — | 0.0089 | — | 18.6 | 1.19 |
| 13 | 0.014 | 0.78 | 1.39 | 0.029 | 0.006 | 15.07 | 19.36 | 2.1 | 5.6 | 0.023 | 0.065 | — | — | 0.0010 | 19.2 | 1.37 |
| 14 | 0.019 | 0.79 | 1.26 | 0.015 | 0.001 | 15.33 | 19.41 | 2.6 | 5.3 | 0.031 | 0.064 | — | — | 0.0071 | 21.2 | 1.17 |
| 15 | 0.018 | 0.68 | 1.12 | 0.025 | 0.001 | 14.89 | 19.65 | 2.3 | 4.6 | 0.032 | 0.034 | 0.0068 | — | — | 20.4 | 1.04 |
| 16 | 0.021 | 0.56 | 1.14 | 0.024 | 0.001 | 15.24 | 19.14 | 2.3 | 3.4 | 0.011 | 0.026 | — | 0.0034 | — | 11.3 | 1.43 |

Colum "REM" represents the total amount of rare earth elements.
fn1 = 2Cu + 0.5Mo + 300N
fn2 = $\{10/(Cu + 0.2)^{2.3}\} + \{5/(Mo + 0.1)^2\} + 300N^2$

TABLE 2

| | Chemical composition (percent by weight) Balance: Fe and unavoidable impurities | | | | | | | | | | | | | | | |
|---|---|---|---|---|---|---|---|---|---|---|---|---|---|---|---|---|
| Steel | C | Si | Mn | P | S | Ni | Cr | Mo | Cu | N | Al | Ca | B | REM | fn1 | fn2 |
| 17 | 0.025 | 0.65 | 1.28 | 0.023 | 0.003 | *10.26 | 18.24 | 2.3 | 5.3 | 0.031 | 0.026 | — | — | — | 21.1 | 1.35 |
| 18 | 0.028 | 0.66 | 1.24 | 0.016 | 0.001 | 15.32 | *14.11 | 2.1 | 5.1 | 0.024 | 0.030 | — | — | — | 18.5 | 1.42 |
| 19 | 0.022 | 0.67 | 1.11 | 0.022 | 0.002 | 15.22 | 18.09 | *1.2 | 5.6 | 0.032 | 0.037 | — | — | — | 21.4 | 3.44 |
| 20 | 0.024 | 0.69 | 1.09 | 0.022 | 0.002 | 15.34 | 18.04 | 2.3 | *2.4 | 0.048 | 0.022 | — | — | — | 20.4 | 2.67 |
| 21 | 0.018 | 0.72 | 1.06 | 0.023 | 0.002 | 15.36 | 18.14 | 2.2 | 4.1 | *0.075 | 0.026 | — | — | — | 31.8 | 2.98 |
| 22 | 0.011 | 0.56 | 1.09 | 0.024 | 0.002 | 15.35 | 18.11 | *5.8 | 5.2 | 0.038 | 0.024 | — | — | — | 24.7 | 0.78 |
| 23 | 0.026 | 0.55 | 1.26 | 0.022 | 0.001 | 15.21 | 18.39 | 3.8 | *8.6 | 0.034 | 0.025 | — | — | — | 29.3 | 0.74 |
| 24 | 0.027 | 0.58 | 1.22 | 0.029 | 0.001 | 15.38 | 18.45 | 4.4 | 5.8 | 0.036 | *0.744 | — | — | — | 24.6 | 0.80 |
| 25 | 0.024 | 0.54 | 1.26 | 0.022 | 0.001 | 16.25 | 19.64 | *0.3 | 3.4 | 0.026 | 0.035 | — | — | — | 14.8 | 32.0 |
| 26 | 0.021 | 0.52 | 1.27 | 0.020 | 0.002 | 15.97 | 18.77 | 2.1 | *0.2 | 0.028 | 0.038 | — | — | — | 9.85 | 83.5 |

TABLE 2-continued

| Steel | Chemical composition (percent by weight) Balance: Fe and unavoidable impurities | | | | | | | | | | | | | | | |
|---|---|---|---|---|---|---|---|---|---|---|---|---|---|---|---|---|
| | C | Si | Mn | P | S | Ni | Cr | Mo | Cu | N | Al | Ca | B | REM | fn1 | fn2 |
| 27 | 0.023 | 0.52 | 1.21 | 0.026 | 0.001 | 15.30 | 18.90 | *1.3 | 5.4 | *0.140 | 0.036 | — | — | — | 53.5 | 8.62 |
| 28 | 0.022 | 0.51 | 1.19 | 0.021 | 0.002 | 15.32 | 18.96 | 2.1 | 5.4 | *0.062 | 0.037 | — | — | — | 30.5 | 2.38 |

Colum "REM" represents the total amount of rare earth elements.
fn1 = 2Cu + 0.5Mo + 300N
fn2 = $\{10/(Cu + 0.2)^{2.3}\} + \{5/(Mo + 0.1)^2\} + 300N^2$
Synbol * indicates falling outside the ranges specified by the present invention.

From the ingot surface of the above-mentioned steels, test pieces having a parallel portion diameter of 10 mm and a length of straight portion of 110 mm were cut out. By use of a Gleeble thermomechanical simulator, test pieces which had been heated at 1280° C. or 950° C. were subjected to a high-temperature tensile test performed at a strain rate of 1/sec, so as to investigate hot workability.

The hot workability was evaluated on the basis of reduction in area (%) of the above-mentioned high-temperature tensile test. Empirical data have shown that steels having reduction in area of 50% or more have adequate hot workability for production.

Subsequently, each remaining portion of the steel ingots was processed in common hot-forging and hot-rolling processes to obtain steel plate of 8 mm thickness. According to the chemical composition of the resultant steel plates, the plates were heated from 1050 to 1150° C. for solution treatment. Then, corrosion test pieces having 3 mm (thickness)×10 mm (width)×40 mm (length) were machined and subjected to a corrosion test in a sulfuric acid environment. Steel 23 containing 8.6% Cu had very poor hot workability as described below, resulting in failure in production of steel plate because of the occurrence of cracking during the hot forging process.

The corrosion test in the above-mentioned sulfuric acid environment was performed by dipping the test pieces in a solution of 100° C. in the temperature and 70% in the concentration of sulfuric acid. Corrosion weight loss was measured after 8-hour dipping, and corrosion rate per unit area was calculated to evaluate sulfuric acid corrosion resistance. The target sulfuric acid corrosion resistance was 2.0 g/($m^2$×h) or less.

Table 3 shows the test results of hot workability and sulfuric acid corrosion resistance.

TABLE 3

| Steel | Sulfuric acid corrosion resistance (corrosion rate) [g/($m^2$ × h)] | Hot workability (reduction in area) at 1280° C. (%) | Hot workability (reduction in area) at 950° C. (%) |
|---|---|---|---|
| 1 | 0.74 | 91 | 56 |
| 2 | 1.12 | 92 | 58 |
| 3 | 1.16 | 92 | 56 |
| 4 | 1.02 | 79 | 50 |
| 5 | 1.43 | 87 | 53 |
| 6 | 1.78 | 86 | 60 |
| 7 | 1.87 | 89 | 66 |
| 8 | 1.56 | 81 | 58 |
| 9 | 0.41 | 81 | 58 |
| 10 | 0.24 | 83 | 55 |
| 11 | 1.19 | 80 | 57 |
| 12 | 1.13 | 84 | 59 |
| 13 | 1.09 | 82 | 57 |

TABLE 3-continued

| Steel | Sulfuric acid corrosion resistance (corrosion rate) [g/($m^2$ × h)] | Hot workability (reduction in area) at 1280° C. (%) | Hot workability (reduction in area) at 950° C. (%) |
|---|---|---|---|
| 14 | 1.14 | 81 | 57 |
| 15 | 1.26 | 81 | 60 |
| 16 | 1.87 | 94 | 68 |
| *17 | **5.15 | 85 | 56 |
| *18 | **8.97 | 89 | 58 |
| *19 | **4.87 | 84 | 55 |
| *20 | **18.9 | 83 | 67 |
| *21 | **8.08 | 74 | **32 |
| *22 | 0.52 | 86 | **38 |
| *23 | — | **0 | **5 |
| *24 | 0.95 | 68 | **18 |
| *25 | **49 | 88 | 63 |
| *26 | **230 | 93 | 81 |
| *27 | **6.28 | 71 | **24 |
| *28 | **3.16 | 78 | **28 |

Steel 23 was not evaluated for corrosion resistance because steel plate could not be produced.
Symbol * indicates falling outside the conditions specified by the present invention, and symbol ** indicates that the target value was not attained.

As is apparent from Table 3, Steel 23 containing more Cu than specified by the present invention had a reduction in area of 0% at 1280° C., and just 5% at 950° C. to have extremely poor hot workability. As described above, this Steel 23 could not produce steel plate, because of the occurrence of cracking during the hot forging process.

Also, Steel 22 containing excessive Mo, Steel 24 containing excessive Al, and Steels 21, 27 and 28 containing excessive N failed to attain a reduction in area of 50% at 950° C. These steels had poor hot workability.

FIG. 1 shows the relationship between the results of hot workability tests at 950° C. and fn1 which is expressed by the above-mentioned equation (1). As is apparent from FIG. 1, steels containing each component element (chemical composition) in an amount falling in a range specified by the present invention, and further having fn1 expressed by the above-mentioned equation (1) of 23.0% or less, had large reduction in area to have excellent hot workability. Moreover, steels having fn1 of 22.6% or less had further excellent hot workability.

On the other hand, as is apparent from Table 3, when steels had higher Cu contents, the steels had higher sulfuric acid corrosion resistance. Incorporation of over 3.0% Cu with Cr and Mo within a range specified by the present invention and further with N in a small amount according to the present invention, resulted in corrosion rate of the target rate; i.e., 2.0 g/($m^2$×h) or less.

Incorporation of more than 4% Cu imparted further higher sulfuric acid corrosion resistance, and incorporation of more than 5% Cu imparted extremely excellent corrosion resistance.

As Mo content increased, the steels had higher sulfuric acid corrosion resistance. Incorporation of over 2.0% Mo with Cu and Cr within a range specified by the present invention and further with N in an amount which the present invention specified, resulted in the target corrosion resistance.

As is apparent, in order to impart further excellent sulfuric acid corrosion resistance to austenitic stainless steels, N should be limited to an amount of less than 0.05%.

It is reasonable that Steel 17 containing little Ni and Steel 18 containing little Cr had poor sulfuric acid corrosion resistance.

Figure 2:
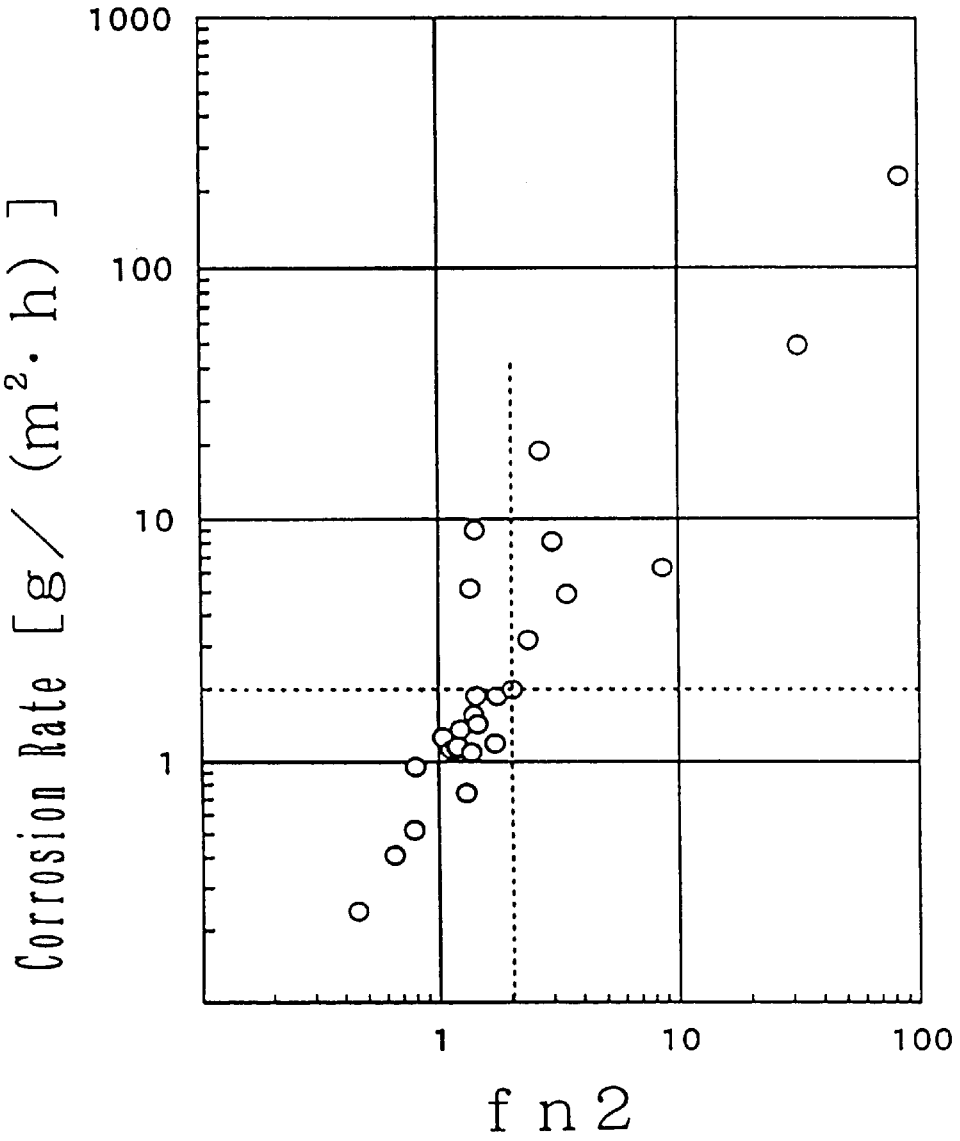
FIG. 2 is a graph showing the relationship between the corrosion rate as measured for the steels used in Examples under conditions of 100° C. in a 70% sulfuric acid solution and fn2, which is expressed by the equation (2) mentioned later.

FIG. 2 shows the relationship between sulfuric acid corrosion resistance (corrosion rate) and fn2 expressed by the above-mentioned equation (2). As is apparent from FIG. 2, steels containing each component element (chemical composition) in an amount falling in a range specified by the present invention, and further having fn2 expressed by the above-mentioned equation (2) of 2.0 or less, had a low corrosion rate and further excellent sulfuric acid corrosion resistance.

Example 2

Austenitic stainless steels having chemical compositions shown in Table 4 were manufactured through a melting process in a 20 kg vacuum induction melting furnace. Steels 29 to 35 in Table 4 are examples of the present invention, and contain each component element in an amount falling in a range specified by the present invention. Steels 36 to 39 in Table 4 are comparative examples, in which any of component elements falls outside a range specified by the present invention. Table 4 includes fn1 expressed by the above-mentioned equation (1) and fn2 expressed by the above-mentioned equation (2).

TABLE 4

| | Chemical composition (percent by weight) Balance: Fe and unavoidable impurities | | | | | | | | | | | |
|---|---|---|---|---|---|---|---|---|---|---|---|---|
| Steel | C | Si | Mn | P | S | Ni | Cr | Mo | Cu | N | Al | Ti |
| 29 | 0.025 | 0.79 | 1.18 | 0.024 | 0.002 | 16.41 | 16.53 | 2.2 | 6.0 | 0.024 | 0.024 | 0.55 |
| 30 | 0.021 | 0.76 | 1.40 | 0.018 | 0.002 | 22.71 | 19.75 | 3.3 | 5.3 | 0.028 | 0.031 | — |
| 31 | 0.024 | 0.71 | 1.29 | 0.016 | 0.002 | 21.56 | 18.50 | 2.3 | 3.2 | 0.044 | 0.076 | — |
| 32 | 0.019 | 0.59 | 1.07 | 0.023 | 0.001 | 17.89 | 17.11 | 3.2 | 5.6 | 0.029 | 0.029 | — |
| 33 | 0.022 | 0.63 | 1.34 | 0.020 | 0.002 | 16.01 | 19.30 | 2.6 | 4.3 | 0.045 | 0.054 | — |
| 34 | 0.029 | 0.69 | 1.26 | 0.022 | 0.003 | 22.03 | 16.94 | 3.1 | 4.5 | 0.036 | 0.061 | — |
| 35 | 0.026 | 0.75 | 1.22 | 0.019 | 0.002 | 18.16 | 16.21 | 3.2 | 5.4 | 0.026 | 0.038 | — |
| 36 | 0.023 | 0.71 | 1.31 | 0.020 | 0.002 | 17.45 | 18.27 | 2.2 | *2.5 | 0.048 | 0.033 | — |
| 37 | 0.021 | 0.75 | 1.26 | 0.026 | 0.001 | 22.16 | 16.23 | 2.4 | 4.5 | *0.075 | 0.027 | 0.38 |
| 38 | 0.018 | 0.53 | 1.08 | 0.019 | 0.001 | 21.38 | 19.49 | 3.4 | *8.1 | 0.036 | 0.052 | — |
| 39 | 0.025 | 0.62 | 1.47 | 0.022 | 0.004 | 19.86 | 18.38 | 2.2 | *0.4 | 0.026 | 0.044 | — |

| | Chemical composition (percent by weight) Balance: Fe and unavoidable impurities | | | | | | | |
|---|---|---|---|---|---|---|---|---|
| Steel | Nb | W | Zr | Ca | B | REM | fn1 | fn2 |
| 29 | — | — | — | — | — | — | 20.3 | 1.27 |
| 30 | — | 4.2 | — | — | — | — | 20.7 | 0.87 |
| 31 | 0.88 | — | 0.82 | — | — | — | 20.8 | 2.05 |
| 32 | — | — | 0.91 | 0.0019 | 0.0031 | — | 21.5 | 0.89 |
| 33 | — | 4.6 | — | — | — | — | 23.4 | 1.61 |
| 34 | — | — | — | — | — | 0.0027 | 21.4 | 1.16 |
| 35 | 0.28 | — | — | — | — | 0.0035 | 20.2 | 0.85 |
| 36 | 0.76 | — | — | — | — | — | 20.5 | 2.65 |
| 37 | — | — | — | — | — | — | 32.7 | 2.77 |
| 38 | — | 3.9 | — | — | — | — | 28.7 | 0.87 |
| 39 | — | — | 0.81 | — | — | — | 10.3 | 33.56 |

Colum "REM" represents the total amount of rare earth elements.

$fn1 = 2Cu + 0.5Mo + 300N$ $fn2 = \{10/(Cu + 0.2)^{2.3}\} + \{5/(Mo + 0.1)^2\} + 300N^2$

Synbol * indicates falling outside the ranges specified by the present invention.

From the ingot surface of the above-mentioned steels, test pieces having a parallel portion diameter of 10 mm and a length of straight portion of 110 mm were cut out. As in Example 1, test pieces which had been heated at 1280° C. or 950° C. were subjected to a high-temperature tensile test performed at a strain rate of 1/sec through use of a Gleeble thermomechanical simulator, and reduction in area (%) was measured so as to investigate hot workability.

Subsequently, each remaining portion of the steel ingots was processed in common hot-forging and hot-rolling processes to obtain steel plate of 8 mm thickness. According to the chemical composition of the resultant steel plates, the plates were heated from 1050 to 1150° C. for solution treatment. Then, corrosion test pieces having 3 mm (thickness)×10 mm (width)×40 mm (length) were machined and subjected to a corrosion test in the same sulfuric acid environment as in Example 1. Steel 38 containing 8.1% Cu had extremely poor hot workability as described below, resulting in failure in production of steel plate because of the occurrence of cracking during the hot forging process.

As in Example 1, the target hot workability was reduction in area of 50% or more, and the target sulfuric acid corrosion resistance was 2.0 g/ ($m^2$×h) or less.

Table 5 shows the test results of hot workability and sulfuric acid corrosion resistance.

TABLE 5

| Steel | Sulfuric acid corrosion resistance (corrosion rate) [g/(m$^2$ × h)] | Hot workability (reduction in area) at 1280° C. (%) | Hot workability (reduction in area) at 950° C. (%) |
|---|---|---|---|
| 29 | 1.14 | 89 | 56 |
| 30 | 0.56 | 87 | 57 |
| 31 | 1.90 | 90 | 54 |
| 32 | 0.51 | 86 | 57 |
| 33 | 1.38 | 802 | 51 |
| 34 | 0.63 | 87 | 56 |
| 35 | 0.59 | 86 | 58 |
| *36 | **21.2 | 87 | 61 |
| *37 | **34.7 | 70 | **29 |
| *38 | 0.68 | **0 | **10 |
| *39 | **157 | 90 | 66 |

Steel 38 was not evaluated for corrosion resistance because steel plate could not be produced.
Symbol * indicates falling outside the conditions specified by the present invention, and symbol ** indicates that the target value was not attained.

As is apparent from Table 5, Steel 38 containing much Cu had a reduction in area of 0% at 1280° C., and 10% at 950° C. to have extremely poor hot workability. As mentioned above, this Steel 38 could not produce steel plate, because of the occurrence of cracking during the hot forging process.

Also, Steel 37 containing excessive N failed to attain a reduction in area of 50% at 950° C. to have poor hot workability.

From Table 5, it is apparent that steels 36 and 39, which have low Cu contents, exhibit low sulfuric acid. corrosion resistance.

It is apparent that steels containing each component element (chemical composition) in an amount falling in a range specified by the present invention, and further having fn1 expressed by the above-mentioned equation (1) of 23.0% or less, had large reduction in area to have excellent hot workability.

It is also apparent that steels containing each component element (chemical composition) in an amount falling in a range specified by the present invention, and further having fn2 expressed by the above-mentioned equation (2) of 2.0 or less, had a low corrosion rate and further excellent sulfuric acid corrosion resistance.

Industrial Applicability

The austenitic stainless steel of the present invention has excellent corrosion resistance, in an environment where high-concentration sulfuric acid is condensed, and excellent hot workability. For this reason, the stainless steel can be used as materials for exhaust gas systems, such as thermal power plant boilers and industrial use boiler equipment (for example, heat exchangers, flues and chimneys), and various types of materials used for flue gas desulfurization equipment in various industries, and structural materials for use in a sulfuric acid environment.

What is claimed is:

1. The austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 22.71 %, Cr: from 16 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01% or less in total, and the balance Fe and unavoidable impurities, wherein fn1 as expressed by the following equation (1) is 23.0% or less:

$$fn1=2Cu+0.5Mo+300N \quad (1),$$

wherein each element symbol shows the amount of the element based on percent by weight.

2. The austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 22.71 %, Cr: from 16 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01 % or less in total, and the balance Fe and unavoidable impurities, wherein fn2 as expressed by the following equation (2) is 2.0 or less:

$$fn2=\{10/(Cu+0.2)^{2.3}\}+\{5/(Mo+0.1)^2+300N^2 \quad (2),$$

wherein each element symbol shows the amount of the element based on percent by weight.

3. The austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 22.71 %, Cr: from 16 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01% or less in total, and the balance Fe and unavoidable impurities, wherein fn1 as expressed by the following equation (1) is 23.0% or less:

$$fn1=2Cu+0.5Mo+300N \quad (1),$$

wherein fn2 as expressed by the following equation (2) is 2.0 or less:

$$fn2=\{10/(Cu+0.2)^{2.3}\}+\{5/(Mo+0.1)^2+300N^2 \quad (2),$$

wherein, in both equations, each element symbol shows the amount of the element based on percent by weight.

4. The austenitic stainless steel, according to claim 1, wherein fn1 is 22.6% or less.

5. The austenitic stainless steel, according to claim 3, wherein fn1 is 22.6% or less.

6. A material for exhaust gas system equipment, such as a thermal power plant boiler or an industrial boiler, wherein a stock of the material is the austenitic stainless steel as described in claim 1.

7. A material for flue gas desulfurization equipment, wherein a stock of the material is an austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: over 15 to 22.71 %, Cr: from 16 to under 20%, Cu: over 3.0 to 8.0%, Mo: over 3.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01% or less in total, and the balance Fe and unavoidable impurities.

8. A structural material used in a sulfuric acid environment, wherein a stock of the material is an austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 22.71 %, Cr: from 16 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01 % or less in total, and the balance Fe and unavoidable impurities.

9. A structural material used in a sulfuric acid environment, wherein a stock of the material is an austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: over 15 to 22.71 %, Cr: from 16 to under 20%, Cu: over 3.0 to 8.0%, Mo: over 3.0 to 5.0%, Nb: 1.0% or less, Ti: 0.5% or less, W: 5.0% or less, Zr: 1.0% or less, Al: 0.5% or less, N: under 0.05%, Ca: 0.01 % or less, B: 0.01 % or less, rare earth elements: 0.01% or less in total, and the balance Fe and unavoidable impurities.

10. A material for exhaust gas system equipment, such as a thermal power plant boiler or an industrial boiler, wherein a stock of the material is the austenitic stainless steel as described in claim 2.

11. A material for exhaust gas system equipment, such as a thermal power plant boiler or an industrial boiler, wherein a stock of the material is the austenitic stainless steel as described in claim 3.

12. A material for flue gas desulfurization equipment, wherein a stock of the material is an austenitic stainless steel having excellent sulfuric acid corrosion resistance and excellent workability, which comprises the following chemical composition based on percent by weight: C: 0.05% or less, Si: 1.0% or less, Mn: 2.0% or less, P: 0.04% or less, S: 0.01% or less, Ni: from 12 to 22.71 %, Cr: from 16 to 26%, Cu: over 3.0 to 8.0%, Mo: over 2.0 to 5.0%, Nb: 1.0% or less, Ti: 0.5% or less, W: 5.0% or less, Zr: 1.0% or less, Al: 0.5% or less, N: under 0.05%, Ca: 0.01% or less, B: 0.01% or less, rare earth elements: 0.01% or less in total, and the balance Fe and unavoidable impurities.

13. The steel of claim 1, wherein the nickel is over 15 and up to 22.71 %, the titanium is less than 0.5%, and the aluminum is less than 0.5%.

14. The steel of claim 2, wherein the nickel is over 15 and up to 22.71 %, the titanium is less than 0.5%, and the aluminum is less than 0.5%.

15. The steel of claim 3, wherein the nickel is over 15 and up to 22.71 %, the titanium is less than 0.5%, and the aluminum is less than 0.5%.

* * * * *

UNITED STATES PATENT AND TRADEMARK OFFICE

CERTIFICATE OF CORRECTION

PATENT NO. : 6,171,547 B1
DATED : January 9, 2001
INVENTOR(S) : Sagara, et al.

It is certified that error appears in the above-identified patent and that said Letters Patent is hereby corrected as shown below:

Claim 2,
Line 21, please correct the formula to read
-- $fn2=\{10/Cu+0.2)^{2.3}\}+\{5/(Mo+0.1)^2\}+300N^2$ .....(2) --

Claim 3,
Line 37, please correct the formula to read
-- $fn2=\{10/Cu+0.2)^{2.3}\}+\{5/(Mo+0.1)^2\}+300N^2$ .....(2) --

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*